United States Patent [19]

Zeyher

[11] 4,012,971

[45] Mar. 22, 1977

[54] ADJUSTABLE WRENCH MECHANISM

[76] Inventor: Craig H. Zeyher, 660 Clinton Ave., Haddonfield, N.J. 08033

[22] Filed: June 30, 1975

[21] Appl. No.: 591,439

[52] U.S. Cl. ..... 81/170; 279/110

[51] Int. Cl.[2] ..... B25B 13/16

[58] Field of Search ..... 81/58, 62, 129, 158, 81/170, 171; 279/66, 110, 116, 117

[56] References Cited

UNITED STATES PATENTS

| | | | |
|---|---|---|---|
| 573,732 | 12/1896 | Warn | 81/170 X |
| 594,023 | 11/1897 | Krueger | 81/155 X |
| 2,726,093 | 12/1955 | Kalenian | 279/116 |
| 3,765,691 | 10/1973 | Saruhashi | 279/110 X |

*Primary Examiner*—Al Lawrence Smith
*Assistant Examiner*—James G. Smith
*Attorney, Agent, or Firm*—Stanley H. Zeyher

[57] ABSTRACT

An adjustable composite wrench adapted for use both as a box or socket wrench and as an Allen wrench. A plurality of work-engaging elements are individually mounted for translational movement along radial paths. Restraining means prevent rotational movement of the work-engaging elements relative to the path of movement. Gear means are operatively associated with each of said elements such that rotation of the gear means causes, in cooperation with the restraining means, translational movement of the element along its radial path. Drive means common to each of the individual gear means provide synchronous movement of the gear means and their associated work-engaging elements whereby such elements are brought into engagement with a work piece.

4 Claims, 5 Drawing Figures

ADJUSTABLE WRENCH MECHANISM

BACKGROUND OF THE INVENTION

The advent of the use of the metric system of measurement has resulted in the need of a plurality of different size tools to accommodate both the United States customary system, or British system, and the International or Metric system. Additionally it is usually necessary in any given assembly to use fasteners of different sizes and types, such, for example, as bolts, machine and hollow set screws, to meet different stress factors and conditions. In order to eliminate the need for a plurality of tools with its attendant expense and waste of materials it has become desirable to provide a single tool having universal application to fasteners of different types and sizes in either system of measurement. The present invention has as its principal objective the provision of such a tool.

The manner in which the foregoing, as well as other objectives and advantages of the invention may best be achieved will be more fully understood from a consideration of the following description, taken in light of the accompanying drawing.

DESCRIPTION OF THE PREFERRED EMBODIMENT

Figure 1:
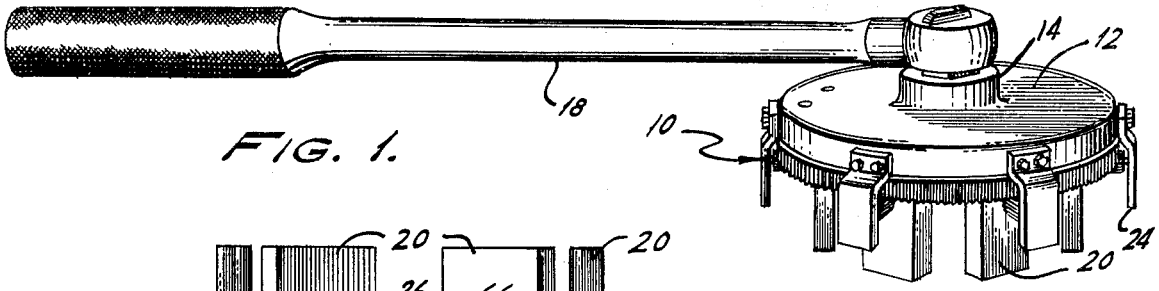
FIG. 1 is a perspective showing of a ratchet driven wrench embodying the invention.
Figure 3:
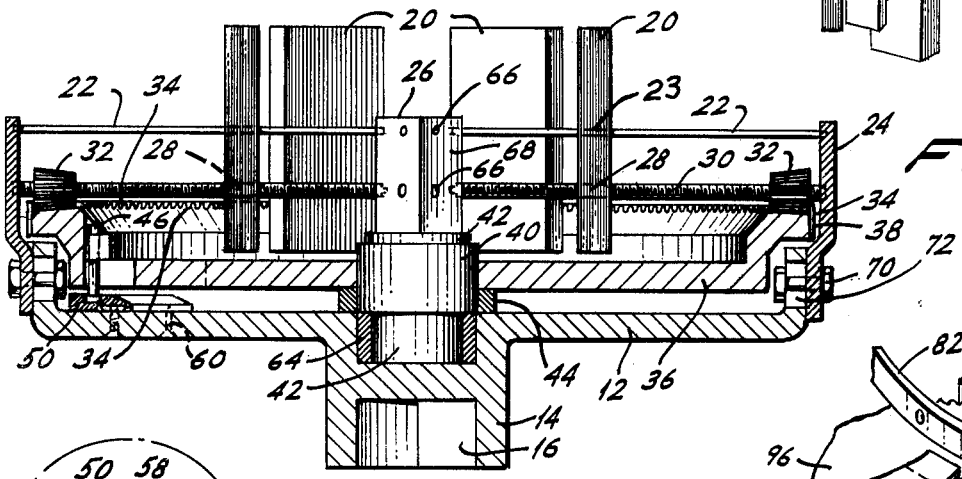
FIG. 3 is a sectional showing of the tool as shown in FIG. 2 taken along the medial plane 3—3.
Figure 3A:
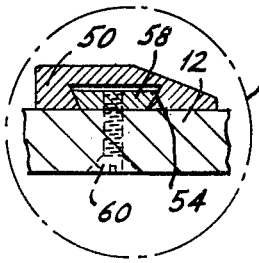
FIG. 3*a* is an exploded sectional view of the indexing plate attachment.
Figure 2:
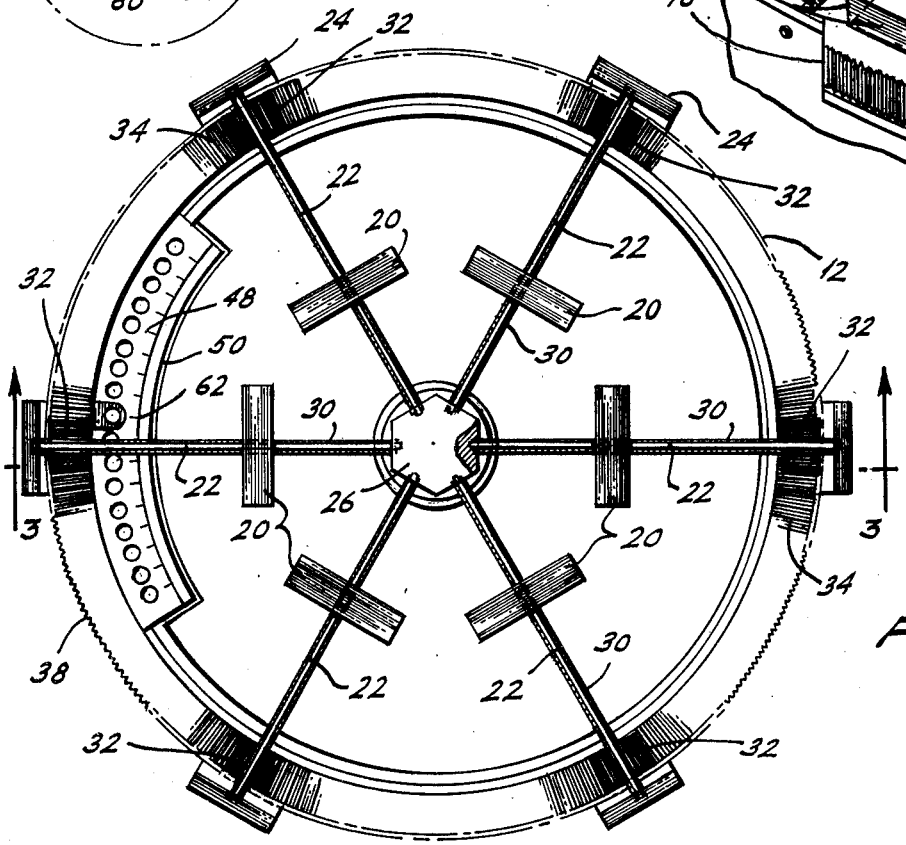
FIG. 2 is an inverted plan view of the tool, as seen in FIG. 1, without the ratchet element.

With more detailed reference to the drawing, there is shown in FIG. 1 an adjustable wrench mechanism 10 embodying the subject invention supported within casing 12. The casing is formed with a boss 14 apertured at 16 to receive a standard ratchet element 18. The wrench mechanism comprises a series of work-engaging elements 20 which in FIG. 1 are shown as depending from the assembly 10. As shown in FIGS. 2 and 3 the elements 20 are mounted for translational movement along paths defined by restraining, or guide means 22. The guide means are supported between adjustable bracket elements 24 and a suitably apertured center post 26. Each work-engaging element 20 is internally threaded at 28 to receive an associated threaded bar 30. The threaded bar 30 has fixedly secured to its outer end a pinion gear 32 and is rotatably supported at its interiorily presented end in center post 26 and at its exteriorly presented end in adjustable bracket 24.

In the embodiment shown in FIGS. 2 and 3 the pinions 32 associated with each of the individual work-engaging elements 20 are driven by a common gear means 34. The gear drive 34 is formed on the upwardly presented face of the rotatable spoked wheel 36. The outer rim surface 38 of the wheel is knurled to facilitate manual rotation thereof. The pinion gear 32 and drive gear 34 thus form a modified rack and pinion whereby movement of the drive gear produces simultaneous and synchronous movement of each of the work-engaging elements 20 through rotation of threaded bar 30 within the threaded hole 28 provided in each element 20. Guide means 22 act to restrain the element 20 against rotation relative to the path of movement cooperatively defined by the guide means 22 and threaded bar 30. The coaction of guide means 22 and threaded bar 30 provide for translation of element 20 long such path upon rotation of the drive gear 34.

The spoked wheel 36 is rotatably mounted on a bushing 40 carried on stub shaft 42 fixedly secured to casing 12. A spacer element, or ring 44, is used to insure proper positioning of the spoked wheel 36 within the assemblage. In adjusting the tool to engage a work piece the drive gear is rotated, through manual manipulation of the knurled edge 38, until the work-engaging elements contact, for example, the outer lands of a bolt or nut, or the inner surfaces of a hollow set screw, as the case may be. At this point a lock element 46 is depressed to engage one of a plurality of apertures 48 formed in indexing plate 50. This action secures the mechanism against further movement during use of the tool. The operation of the locking element is the same as that employed in a conventional retractable pen and accordingly is not believed to require further elaboration. The apertured index plate is itself adjustable as shown in the enlargement 52. The plate 50 is formed with a groove 54 in its under surface which is engaged by a tongue element 58 adjustable secured to casing 12 by machine screws 60. By loosening the screws 60 the index plate may be slidably moved with respect to the tongue 58 until proper calibration has been achieved. Once the unit has been calibrated it may be adjusted for use without the need for initial placement on the work piece. To facilitate this type of adjustment the indexing plate may have placed on its upper surface, as by use of an adhesive paper overlay, or by other suitable means, appropriate indicia of measurement as shown at 62.

The use of adjustable brackets 24 permits ready assembly and disassembly of the unit and facilitates adjustment for wear and replacement of defective or worn parts. In assemblying the unit, the indexing plate 50 is first positioned within the casing and temporarily locked in place by tightening adjusting screws 60. Next the bushing 40 is placed in position over the shaft 42 which as previously noted is fixedly secured to casing 12 as for example by being press fit into recess 64 provided in the floor of casing 12. The spacing collar 44 is then placed in position over bushing 40 and the spoked wheel 36 placed over bushing 40 and onto spacer 44. Next the threaded bars 30 are each screwed into and through their respective workengaging elements 20 an equal distance followed by placement of the guide, or restraining, bars 22 through the unthreaded apertures 23 provided in each of the work-engaging elements 20. Each of these elements with the threaded bar 30 and guide rail 22 in place is then assembled within the unit by placing the inwardly presented ends of the bars into recesses 66 provided in the champhered wall sections 68 formed on the upper portion 26 of shaft 42. The outwardly presented ends of the threaded bar 30 and guide rail 22 are then positioned in appropriate recesses provided in the associated bracket 24 and the bracket secured in place on casing 12 by machine screws 70. By means of an elongated aperture 72 provided in the wall of casing 12 the brackets 24 can be adjusted vertically to bring the pinion gear 32, fixedly secured to threaded bar 30, into running engagement with gear 34 formed on the upper surface of spoked wheel 36. As previously noted the gears 32 and 34 act as a rack and pinion. With the elements of the mechanism so assembled the wrench is ready for use. Any adjustment needed by reason of wear or replacement of parts can be readily accomplished through adjustment of brackets 24.

Figure 4:
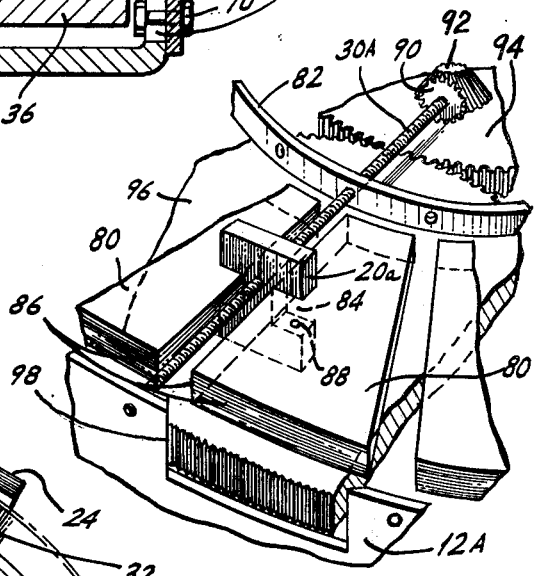
FIG. 4 is an exploded sectional view of an alternative embodiment of the invention designed to achieve the same end objectives by different, but equivalent, mechanical means.

Alternative means for achieving the same end results as the mechanism illustrated in FIGS. 2 and 3 are shown in FIG. 4. In this embodiment the restraining or guide means are formed by plates 80 which are secured, by means not shown, between retaining ring 82 and wall portions of casing 12A. Except as hereinafter noted casing 12A is substantially the same in construction as casing 12 and consequently has not been shown in detail. The work-engaging elements 20A, only one of which has been shown, are provided with grooves 84 which slidably ride on edge portions 86 of adjacent plates 80. To insure substancially frictionless movement of elements 20A on plates 80 confronting surfaces of the grooves are provided with partially recessed ball bearings 88.

In the embodiment shown in FIG. 4 the work-engaging elements 20A are driven by threaded bars 30A which fixedly carry on their inwardly presented end portions a cone gear 90. The cone gear 90 is driven by a mating cone gear 92 of a size sufficient to accommodate the requisite number of cone gears. The gear 92 is carried on spur gear 94 which in turn meshes with a manually movable gear 96. Both gears 94 and 96 are rotatably mounted on stub shafts, not shown, mounted within the casing 12A. The work-engaging elements 20A are caused to move along the radial paths defined by the plates 80 and threaded bars 30A by simply rotating the drive gear 96, an edge portion of which is made accessible to the user through an opening 98 provided in a side wall portion of casing 12A.

As previously noted on the work-engaging elements in either of the illustrated embodiments may be used either as a box or socket wrench or alternatively as an Allen wrench or key for a hollow set screw. This duality of function plus the adjustability of the tool to fit various sizes of fasteners makes it an extremely useful tool. It will be appreciated that the objectives of this invention may be achieved by mechanical equivalents of the structures shown, these being merely exemplary of preferred means of achieving the desired results.

I Claim:

1. Wrench mechanism comprising: a casing; bracket means adjustably secured to the casing; gear means mounted for rotational movement within said casing; a series of threaded bars disposed in radial array within said casing each of which is journaled at one of its ends in said adjustable bracket means and at its opposite end in support structure carried by said casing; a gear drive secured to one end of each of said bars for rotation therewith and held in driving engagement with said gear means by said bracket means; a plurality of work-engaging elements formed cooperatively to serve as either an internal or external wrench and each of which is threadably engaged by individual ones of said threaded bars; and restraining means contacting each of said work-engaging elements to prevent rotational movement thereof whereby rotation of said gear means causes translational movement of said work-engaging elements along the radial paths defined by said threaded bars.

2. Wrench mechanism according to claim 1 including plunger mechanism carried by said gear means and detent means carried by said casing the coaction of which serves to lock said gear means against rotation relative to said casing.

3. Wrench mecanism according to claim 2 including wrench-size-indicating indicia associated with said detent means whereby operation of said plunger mechanism serves both to lock said gear means against rotation relative to said casing and to index the wrench mechanism relative to the work piece.

4. Wrench mechanism according to claim 1 including socket means carried by said casing for attachment of ratchet means thereto.

* * * * *